US005305957A

United States Patent [19]

Szocs

[11] Patent Number: 5,305,957

[45] Date of Patent: Apr. 26, 1994

[54] PROCESS AND APPARATUS FOR THE FINE DISPERSION OF LIQUIDS OR POWDERS IN A GASEOUS MEDIUM

[76] Inventor: Istvan Szocs, Nemetvolgyi ut 10, H-1126 Budapest, Hungary

[21] Appl. No.: 571,668

[22] PCT Filed: Aug. 16, 1989

[86] PCT No.: PCT/HU89/00043

§ 371 Date: Oct. 12, 1990

§ 102(e) Date: Oct. 12, 1990

[87] PCT Pub. No.: WO90/07373

PCT Pub. Date: Jul. 12, 1990

[30] Foreign Application Priority Data

Jan. 4, 1989 [HU] Hungary ..... 20/89

[51] Int. Cl.[5] ..... A62C 35/02; A62C 13/66

[52] U.S. Cl. ..... 239/302; 239/101; 239/8; 169/28; 169/9; 169/85; 169/58

[58] Field of Search ..... 169/84, 85, 9, 28, 58; 239/99, 101, 569, 570, 533.1, 302, 398, 8; 222/195

[56] References Cited

U.S. PATENT DOCUMENTS

| | | | |
|---|---|---|---|
| 1,099,767 | 6/1914 | Read | 169/85 |
| 2,713,391 | 7/1955 | Buckholtz | 169/28 |
| 2,719,589 | 10/1955 | Mapes | 169/28 |
| 4,319,640 | 3/1982 | Brobeil | 169/28 |
| 4,589,496 | 5/1986 | Rozniecki | 169/28 |

FOREIGN PATENT DOCUMENTS

| | | | |
|---|---|---|---|
| 359362 | 1/1906 | France | 169/85 |
| 376630 | 2/1907 | France | 169/85 |
| 1461481 | 2/1989 | U.S.S.R. | 169/85 |
| 1463319 | 3/1989 | U.S.S.R. | 239/99 |

*Primary Examiner*—Andres Kashnikow
*Assistant Examiner*—Christopher G. Trainor
*Attorney, Agent, or Firm*—Young & Thompson

[57] ABSTRACT

A process and apparatus for the fine dispersion of liquid or powder in a gaseous medium, preferably in air. The liquid or powder is placed into an ejection tube (2) and pressurized gaseous propellant (4) is conducted at explosion-like speed behind the charge (1). The apparatus has an ejection tube (2) containing the liquid or powder charge (1), a propellant container (3) connected with one end of the ejection tube (2). The ejection tube (2) and propellant container (3) are interconnected by at least one transfer port (8) closed by a quick-action locking element.

24 Claims, 11 Drawing Sheets

PROCESS AND APPARATUS FOR THE FINE DISPERSION OF LIQUIDS OR POWDERS IN A GASEOUS MEDIUM

FIELD OF THE INVENTION

The present invention relates to a process and apparatus for the fine dispersion of liquids or powder in gaseous medium, preferably in air.

BACKGROUND OF THE INVENTION

It is well known that the fine dispersion of liquids or powders in the air, or in other medium or surface is often necessary. The fields of application can be divided into two main groups.

One of them includes the applications where the quantity of the product discharged on each occasion is not considerable (therapeutic, cosmetic, household applications etc). The aerosol products were developed just for this purpose. These products are filled into pressurized containers and by actuating a valve mechanism, they pass to the air through an atomizer system. The finely dispersed liquid drops (aerosol drops) are produced by the atomizing nozzle.

Though the size could be increased, containers liter volume are usually not produced.

In the other group of applications a considerable amount of product is to be used on each occasion, as acceptable result will be attained only this way. Such fields of application are for example the disinfection of buildings, fire fighting, etc. Sprayers or atomizers of continuous operation are used for this purpose.

One cf these solutions is described in the HU-PS 185 548. This device is an improvement of the apparatus described in the DE-PS 28 40 723, U.S. Pat. No. 1,399,490, U.S. Pat. No. 4,116,387 and U.S. Pat. No. 4,251,033 for the purpose of administering active ingredients for therapeutic or immunogenic treatment of animals kept in stable. The apparatus consists of a high capacity rotary atomizer and conical drop separators opening by way of shutter. These drop separators prevent the passage of drops greater than 5 micron into the air space.

The apparatus according to the U.S. Pat. No. 4,687,135 was developed for discharge into the air space with high energy. The propellant in the apparatus is brought about by the explosion-like burning of gas, and pulverized metal, metal-ceramic, wear- and heat-resistant electrically insulating or electrically conducting material are admitted into the nozzle. The pulverized substance flowing out of the nozzle heated to the vicinity of its melting point, precipitates with high energy on the treated surface, forming a layer on it. The apparatus functions periodically.

These apparatuses are capable to discharge theoretically unlimited amount of product, but in fact they slow, because increasing the quantity discharged in time unit is restricted by the atomizing system. The slowness is unfavourable especially in apparatuses used for fire fighting, e.g. in fire extinguishers.

There are instances, among which the underground fire is the most characteristic, when very large amount of product has to be dispersed nearly all at once into a very large space. With the currently known spraying systems this is impossible, or it can be realized only with apparatuses of unacceptable size.

SUMMARY OF THE INVENTION

The object of the present invention is therefore a process and apparatus whereby a great amount of liquid or powder can be dispersed all at once in gaseous medium, e.g. air space. The invention is based on the recognition, that if liquid is discharged into the air at high speed, the air resistance might be so great that it breaks down the mass of liquid to drops by impact. Similar is the behaviour of the fine grained powders. The speed of discharging the liquid or powder is therefore a crucial question.

According to the present invention for the dispersion of liquid or powder in gaseous medium, preferably in air, the liquid or powder is arranged in an ejection tube, and pressurized propellant gas flow is produced behind the charge at an explosion-like speed.

Preferably, a propellant gas of at least 10 bar pressure is conducted behind the charge in at most 20 msec.

According to a preferred embodiment a container is charged up with propellant of at least 10 bar pressure, and the gas is conducted from the container behind the charge in the ejection tube.

The liquid or powder may be also filled into a synthetic foil or paper bag, then the bag is sealed and placed into the ejection tube.

Generally, the charge fills up 25–100% of the ejection tube's volume and a propellant 30–750 times the volume of the charge in normal condition is conducted to the charge.

The propellant gas may also be brought about by explosion, wherein an explosive in a conventional shell is placed into the propellant container and the charge filled into the bag is put directly on the explosive.

Another object of the invention is an apparatus for the fine dispersion of liquid or powder in gaseous medium, preferably in air appropriately with the process according to the invention, when the apparatus is designed as to have an ejection tube taking in the charge of liquid or powder, one end of the ejection tube is attached to the propellant container, the ejection tube is interconnected with the propellant container at least by one transfer port closed with a quick-action locking element.

In a preferred embodiment of the apparatus according to the invention the ratio between the length and inside diameter of the ejection tube is 2–20.

In another preferred embodiment of the apparatus according to the invention, an automatic locking element of elastic material, consisting of segments is arranged at the mouth of the ejection tube.

Yet another preferred embodiment of the apparatus according to the invention is when the ejection tube has a charging stub provided with locking element, connected through flexible hose with a liquid supply system.

A tube bottom may be formed at the end of the ejection tube facing the propellant container, and holes are branching off from the transfer port in the direction of the ejection tube, the openings of which are formed in the tube bottom close to its edge.

The propellant container may have a charging stub provided with a locking element ensuring connection with the propellant supply appliance and connected through a flexible hose with a power system supplying high pressure gas. It may also have conventional elements for taking in a $CO_2$ cartridge.

The locking element closing the transfer port that interconnects the ejection tube with the propellant container is a valve lying on the valve seat machined around the transfer port from the direction of the propellant container, the valve is in actuating connection with a piston situated in the cylinder, the cylinder space is interconnected with the propellant container through a check valve closing towards the cylinder space, furthermore through a locking element with the surroundings, and finally the charging stub of the propellant container provided with locking element is connected directly with the cylinder space.

The locking element in the charging stub of the propellant container interconnected with the cylinder space and the locking element interconnecting the cylinder space with the surroundings may be machined as a single three-position locking element.

According to another preferred embodiment of the apparatus according to the invention, the valve closing the transfer port that interconnects the ejection tube with the propellant container and the valve-actuating piston are machined as a single piece, and cross section of the transfer port is smaller than that of the cylinder space, wherein the locking element closing the transfer port is a butterfly valve, a ball pivot or a membrane.

A bursting mandrel may be arranged behind the membrane closing the transfer port that interconnects the ejection tube with the propellant container, the shank of which is in mechanical connection with the actuating mechanism arranged outside the propellant container.

Preferably, the compressive strength of the membrane closing said transfer port is 1.2–1.5 times the rated charging pressure of the propellant container.

A detonating mechanism, preferably primer cap may be built to the membrane closing the transfer port interconnecting the ejection tube with the propellant container, and said primer cap can be interconnected with a firing mechanism.

In a further preferred embodiment of the apparatus according to the invention, explosive is in the propellant container built together with a conventional detonating mechanism (primer), and the detonating mechanism is interconnected with a firing mechanism.

Again in a further preferred embodiment of the apparatus according to the invention, the firing mechanism interconnected with the detonating mechanism built to the membrane closing the transfer port that interconnects the ejection tube with the propellant container, or the firing mechanism interconnected with the detonating mechanism built to the explosive in the propellant container is in actuating connection with a device or device system sensing the presence cf explosive gas mixture and/or fire.

Finally, in a further preferred embodiment of the apparatus according to the invention, at least two ejection tubes are built together with a common propellant container, and each ejection tube is connected separately with the common propellant container through a transfer port closed by a locking element.

BRIEF DESCRIPTION OF THE DRAWINGS

The invention will be described more in detail by way of some examples with the reference to the enclosed drawings, in which.

DETAILED DESCRIPTION OF THE INVENTION

The previous description demonstrates that the process according to the invention can be realized in several ways and many kinds of apparatuses are suitable for this purpose. For the sake of easier representation it is more expedient to present an apparatus in detail, and following the description of its operation to refer back to the process.

Figure 1:
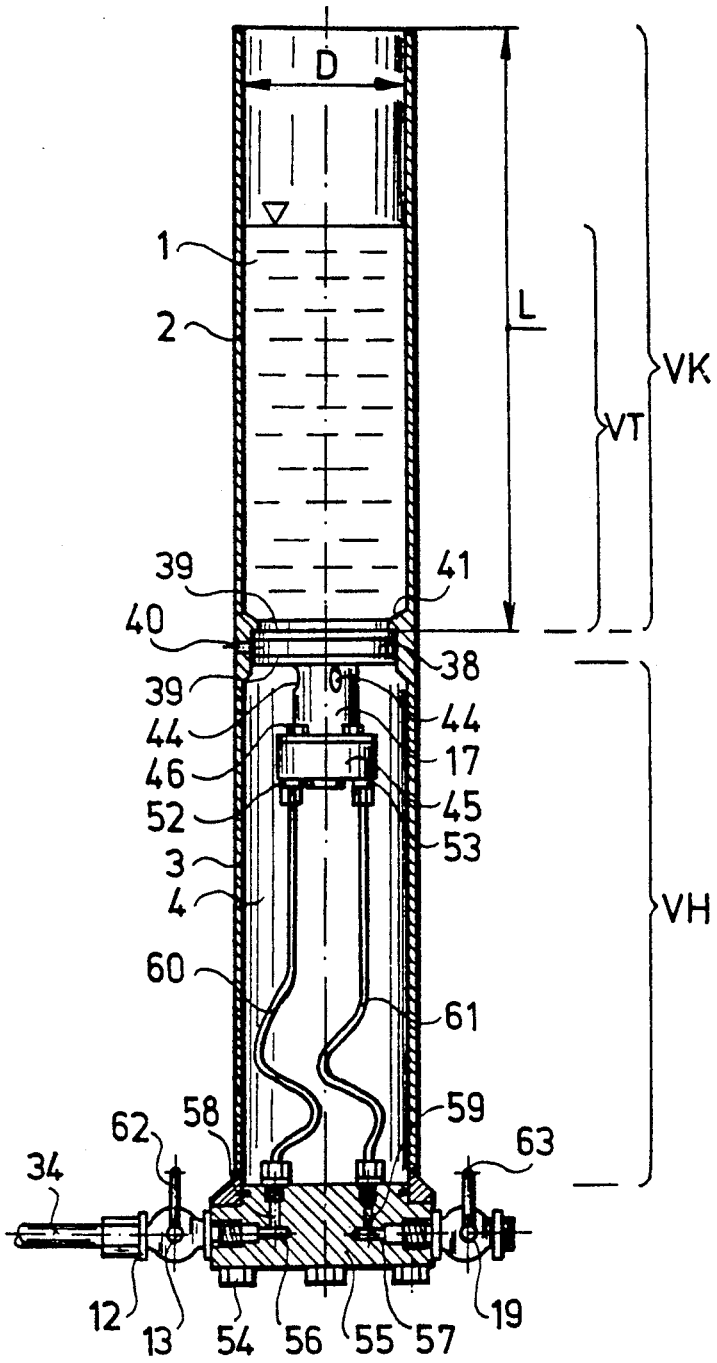
FIG. 1 is the longitudinal section of a version of the apparatus according to the invention

The ejection tube 2 and propellant container 3 of the apparatus shown in FIG. 1 are machined as a single steel tube. They are separated from each other by a dividing wall 38 sealed by gaskets 39. Its displacement is prevented by shoulder 41 machined from the direction of ejection tube 2 and by setscrew 40.

Figure 2:
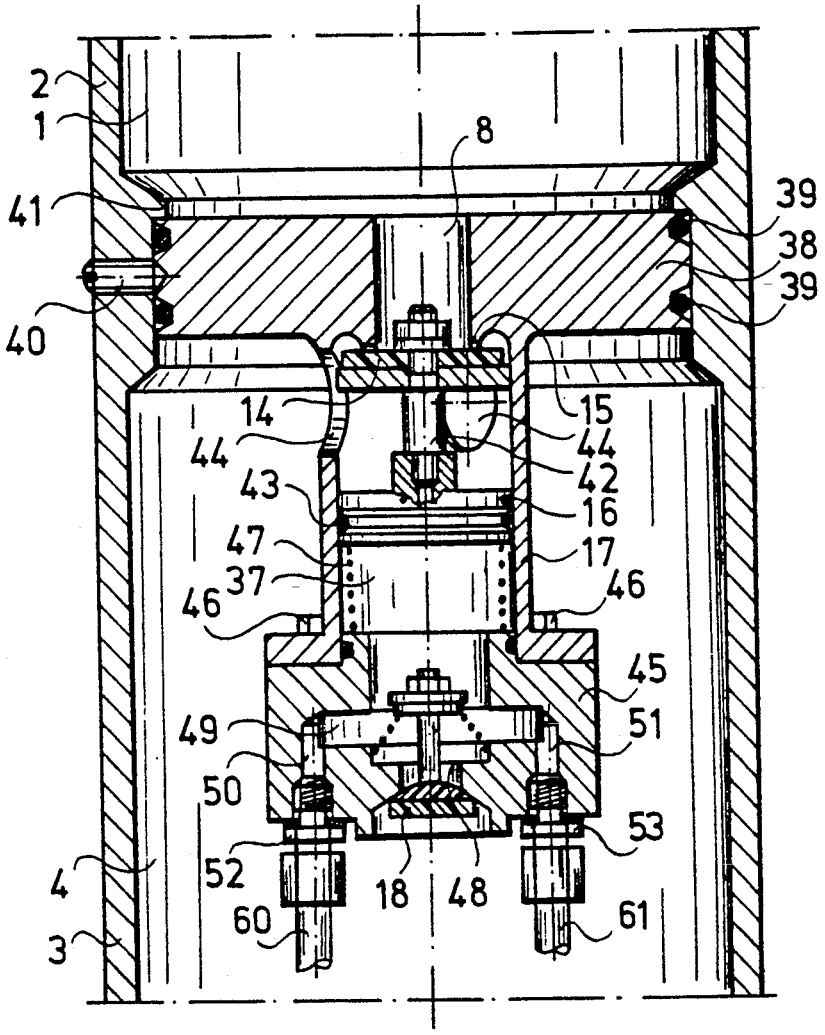
FIG. 2 is the detail of the same.

The dividing wall 38 is shown in detail in FIG. 2. A transfer port 8 is arranged in the central part interconnecting the ejection tube 2 and propellant container 3. A valve seat 15 is machined around the transfer port 8 from the direction of the propellant container 3 closed by a disc gate valve 14.

The valve 14 is interconnected with piston 16 via valve stem 42. The piston 16 is arranged in a cylinder 17 made in the present case as a single piece with the dividing wall 38. Tightness of the piston 16 is ensured by sealing ring 43. Windows 44 are cut in the wall of the cylinder 17 in the vicinity of valve 14 through which the propellant flows to the valve 14 .

The cylinder 17 is closed by a cover 45 fixed with screws 46. A spring 47 is inserted between the piston 16 and cover 45, which has no distinctive role in respect of the operation, it improves the safe operation only.

A hole 48 in the central part of cover 45 is interconnecting the cylinder space 37 with the space of the propellant container 3. The hole 48 is closed by a check valve 18 from the direction cf the propellant container's space.

An annular space 49 connected with the cylinder space is machined in the cover 45 which is connected through holes 50 and 51 with threaded pipe nipples 52 and 53.

The propellant container 3 in the present case is a mounted construction, meaning that its end is closed by a bottom piece 55 fixed with screws 54. Ducts 56 and 57 are in the bottom piece 55 containing threaded pipe nipples 58 and 59 from the direction cf the propellant container 3.

As continuation of duct 56 locking element 13 and as continuation of duct 57, locking element 19 are connected with the bottom piece 55. These are ball pivots actuated by handles 62 and 63. The free end of locking element 13 forms the charging stub 12 of the propellant container 3. Charging stub 12 is connected through flexible hose 34 with a compressed air aggregate (not shown). Locking element 19 opens towards the surroundings.

The threaded pipe nipples 56 and 59 in the bottom piece 55 are interconnected through flexible hoses 60 and 61 with threaded pipe nipples 53 and 53 in the cover 45 of cylinder 17.

The process according to the invention is as follows.

Upon opening locking element 13, compressed air flows through flexible hose 34 into duct 56. The cylinder space 37 of cylinder 17 is charged up through duct 56 and annular space 49. The spring 47 keeps the piston 16 and valve 14 through valve stem 42 in the direction of transfer port 8, thus the valve 14 rests on valve seat 15 and closes the transfer port B. Now the compressed air increases the force closing the valve 14.

As the pressure rises in the cylinder space 38, the check valve 18 opens, and the propellant container is charged up with propellant 4, i.e. compressed air. Upon completion of the charging, the locking element 13 has to be closed by turning the handle 62.

During this period of the operation the locking element 19 has to be kept in closed condition.

Simultaneously with charging up the propellant container 3, the charge 1 can be placed into the ejection tube 2. In the present case it is water as indicated in FIG. 1. By filling up the charge 1 and propellant 4, the apparatus is ready to eject.

For ejection cf charge 1, the locking element 19 has to be opened by turning the handle 63. At this point, the cylinder space 37 cf cylinder 17 becomes discharged through the annular space 49, hole 51, flexible hose 61, duct 57 and locking element 19 towards the surroundings. Pressure of the propellant 4 in the propellant container 3 moves the piston 16 in the direction of the cover 45, thereby lifting the valve 14 off the valve seat 15.

Opening of the valve 14 is extremely quick, it takes only milliseconds. Through the free transfer port the propellant 4 presses onward with elementary force below the charge 1 and ejects it from the ejection tube 2 at high speed, and it disintegrates in the air forming nearly regular fog.

After ejection, charging of the apparatus can be repeated, i.e. the actuation is periodical.

As it is expected from the foregoing, the result of the process depends on several factors.

First of all, the speed of the process in time and magnitude of the utilized energy have a decisive role. If the propellant 4 is brought behind the charge 1 in a longer time than 20 msec, or the pressure of the propellant does not reach 20 bar, then neither the size of the liquied drops, nor their distribution will be homogeneous, and the drop size will be greater than to speak about fog, spray or aerosol.

Even if complying with the former requirements, considerable deviation will appear from the L/D ratio of the ejection tube (L=length, D=diameter) and from the ratio of the volume VK of the ejection tube and volume VT of the charge 1. These two characteristics influence fineness of the atomization, range of the ejection, and cone angle of the dispersion.

The L/D ratio should be selected between 2 and 20. If the L/D ratio is smaller than two, the cone angle of the dispersion will be so much that the atomization is no longer homogeneous, the drops spreading to the side will be unacceptably large, and their energy low, thus they do not get far enough. The L/D ratio theoretically could be greater than 20, but it is unnecessary, as it would not influence the result of the process.

Ratio between the volume of the ejection tube VK and volume of the charge VT should be selected between 25 and 100%. Its effect is in direct proportion to the cone angle of the dispersion, i.e. if ratio of the volumes is smaller, the cone angle of the dispersion will also be smaller. Ratio of the volumes influences not only the described effect of the cone angle of dispersion . At smaller volume ratio the coverage of the apparatus is greater and the atomization is finer and more homogeneous.

Finally, the ratio between volume of the charge VT and volume of the propellant VH measured in normal condition will considerably influence marking out the field of application of the apparatus. This ratio can be selected between 30 and 750. It is evident that this characterizes the magnitude of the energy utilized for ejection. It has to be premised that the apparatus according to the invention can be produced as to be kept in the hand, but it may be produced with large dimensions in stable construction.

The manual use, e.g. small fire extinguishers do not require great energy, and the use is not recommended either, because the reaction force might be too excessive causing injury to the operator.

At the same time, the invention enables to produce apparatuses suitable for quenching oil or gas bursts. These apparatuses are set up on a fixed stand farther from the boring tower, and the ejection is carried out with such energy, that not only the fine extinguishing charge should be effective, but the flame would be blown out as well.

It is pointless to increase the energy without restraint. The air resistance absolutely limits both the range and narrowing the dispersion. Therefore, it is unnecessary to go over 750 with the volume ratio.

Figure 3:
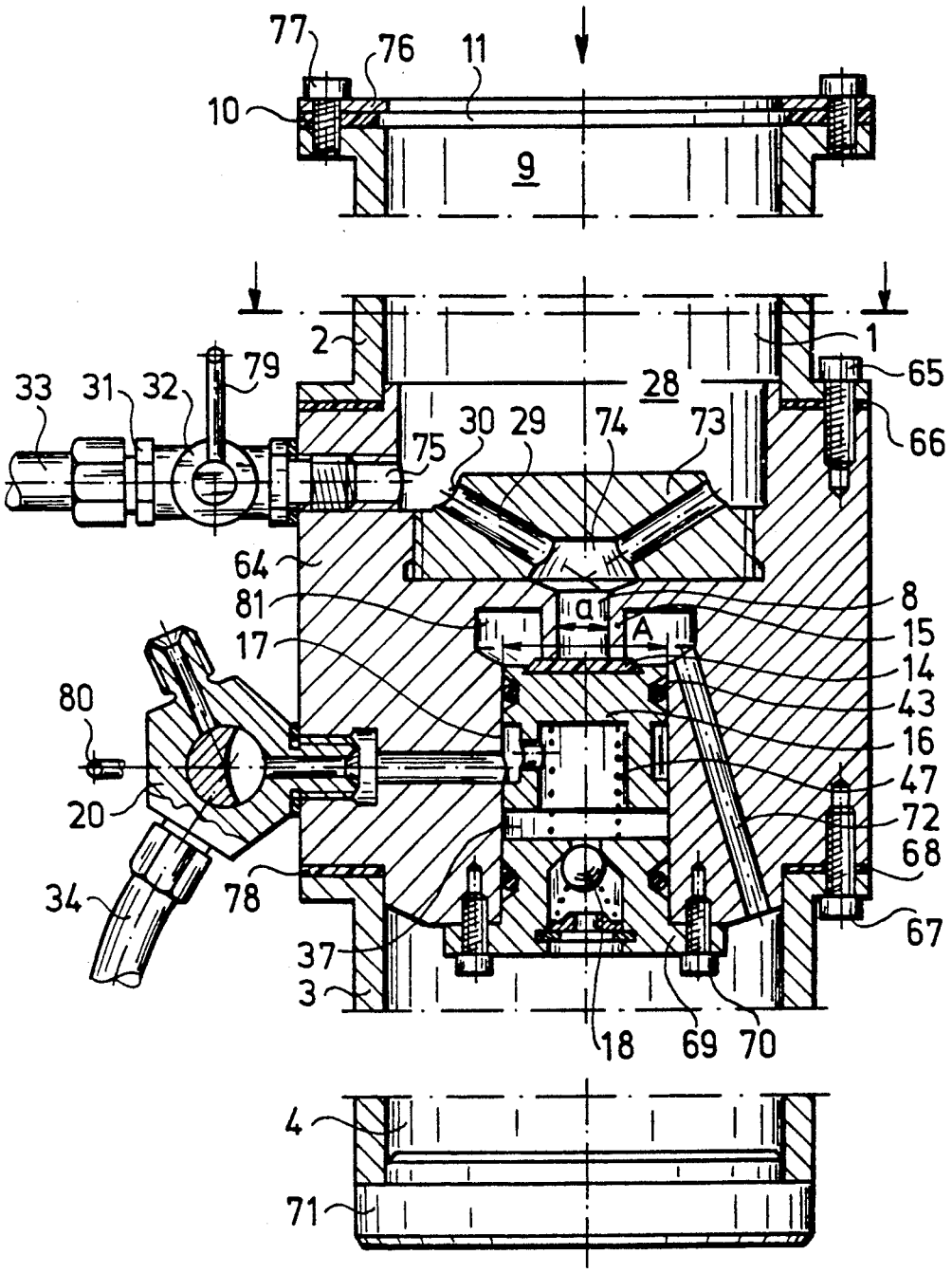
FIG. 3 is the longitudinal section of another version.
Figure 4:
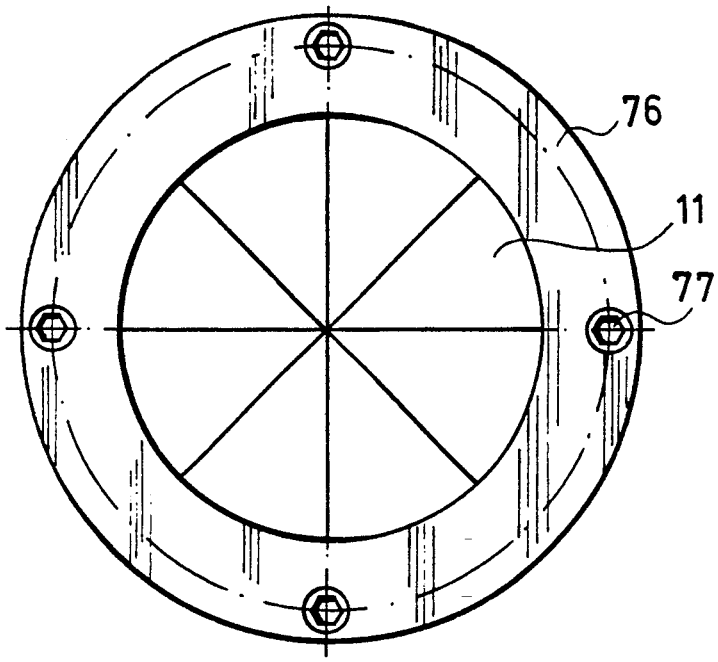
FIG. 4 is the top view of the same.
Figure 5:
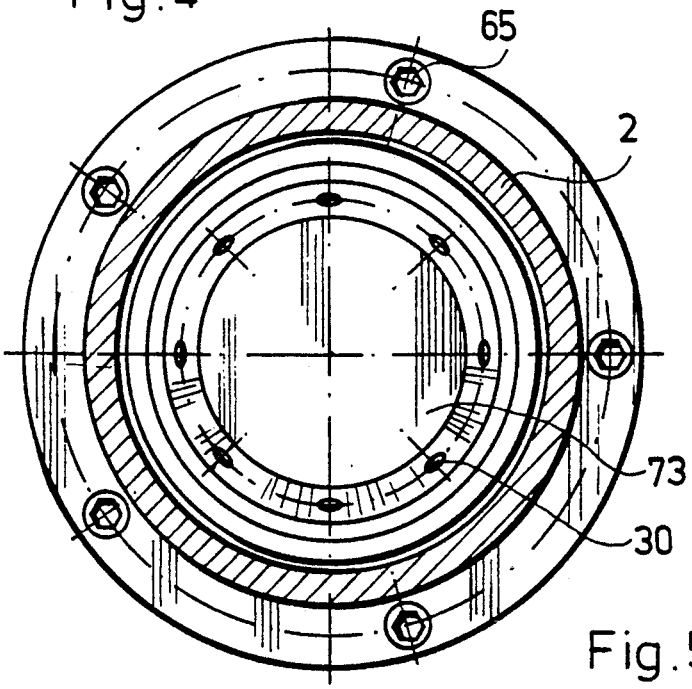
FIG. 5 is the cross section marked with I in FIG. 3.

The version suitable for manual use is shown in FIG. 3 to 5.

The ejection tube 2 and propellant container 3 are made independently and mounted on both sides of the distance piece 64. The ejection tube 2 is fixed with screws 65 with the aid of welded-on flanged hub, the gasked 66 between them ensures leakageproof condition. The propellant container 3 is fixed to the distance piece 64 similarly with a welded-on flanged hub. It is fixed with screws, and sealed by gasket 68.

End of the propellant container 3 is closed with a welded bottom piece 71.

The transfer port 8 is machined into the distance piece 64. The lower end of the interior of the ejection tube 2 forms the tube bottom 28 in the distance piece 64 so that a threaded insert 73 is driven into the distance piece 64. Holes 29 are in the insert 73 branching off from the transfer port 8, and their openings 30 open along the circumference of the tube bottom 28 into the space of the ejection tube 2. The holes 29 start out of a distribution space 76, this however is regarded in respect of flow as part of the transfer port 8.

The valve seat 15 on which the valve 14 rests is machined around the end of the transfer port 8 facing the propellant container 3.

The valve 14 and the actuating piston 16 are made as a single piece. The operation is conditional on the cross section A of piston 16 being greater than the cross section a of the transfer port 8.

The cylinder 17 with the piston 16 in it is machined in the distance piece 64. The piston 16 is sealed with a packing ring 43 shaped like a pot to prevent jamming. Its operation is ensured by spring 47 as described earlier.

The cylinder space 37 of cylinder 17 is closed by cover 69 fixed with screws 70 to the distance piece 64. Check valve 18 is in cover 69 opening towards the space of propellant container 3.

An annular valve space 81 is on the side of piston 16 facing the valve seat 15. The valve space is interconnected through ducts 71 with space or the propellant, container 3. Only one duct 72 is shown in the drawing, but it is advisable to prepare more of them because of the lower flow resistance.

A hole 76 in the distance piece 64 adjoins the cylinder space 37. The three-position locking element 20 adjoins the hole 78. One of the connecting stubs of the three-position locking element 20 is connected through flexible hose 34 with a compressed air aggregate (not shown), and the other connecting stub opens to the surroundings. The three-position locking element 20 is actuated by handle 80.

A hole 75 leading to the space of the ejection tube 2 is on that part of the distance piece 64 which surrounds the space of the ejection tube 2. A charging stub 31 adjoining through locking element 32 the hole 75 is connected through flexible hose 33 with a water cock (not shown). The locking element 32 is a ball pivot actuated with handle 79.

A locking element 10 is fixed to the mouth 9 of the ejection tube 2. This may be a rubber sheet divided into segments 11. The locking element 10 is pressed by ring 76 to the tube mouth 9. The ring 76 is fixed by screws 77.

The apparatus generally functions as described before.

In one position of the three-position locking element 20, the cylinder space 37 is connected through flexible hose 34 with a compressor. Thus the piston 16 keeps the valve 14 in closed state, while the propellant container is charged up through check valve 18 with propellant 4, in this case compressed air.

After charging up the propellant container 3, the three-position locking element 20 is turned by handle 80 to the position marked in FIG. 3.

By opening the locking element 32, the ejection tube 2 can also be charged up. Naturally the earlier described aspects have to be reckoned with for charging up. After charging up the ejection tube 2, the locking element 32 can be closed with handle 79. Now the apparatus is ready for actuation.

It is actuated by turning the three-position locking element 20, when it interconnects the cylinder space 37 through hole 78 with the surroundings. At this point the piston moves and the valve 14 opens the transfer port 8. The outflowing propellant 4 ejects the charge 1.

The apparatus is made specifically for manual use, therefore it is provided with grip and shoulder strap (not shown). The manual use necessitates the application of locking element 10 with segments 11 at the tube mouth 9. This prevents charge 1 from flowing out of the ejection tube 2 during movement of the apparatus.

The manual actuation is served similarly by the three-position locking element 20. Compared with the earlier described apparatus, it is easy to see that the three-position locking element 20 can be regarded as a built together unit of the charging locking element 13 and locking element 19 starting the ejection.

Purpose of the holes 29 opening to the tube bottom 28 is to conduct the propellant 4 evenly below the charge 1. Its effect is manifest in reducing the cone angle of dispersion, which is significant indeed in the large diameter ejection tubes.

Figure 6:
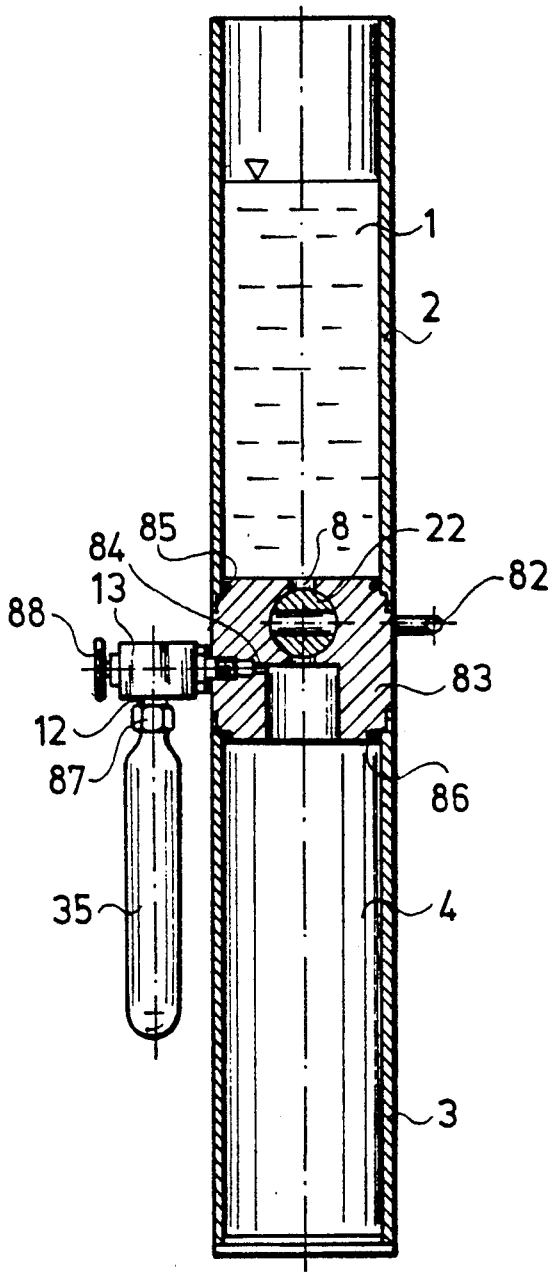
FIG. 6 is the longitudinal section of a third version.

A similarly light, manual apparatus is presented in FIG. 6.

The ejection tube 2 and propellant container 3 are fixed with threaded connection to both sides of a distance piece 83. Packing rings 85 and 86 are used for sealing. End of the propellant container 3 is closed by a bottom element 71 as described earlier.

The distance piece 83 includes the transfer port 8 with a built in ball pivot 22 actuated by handle 82.

A locking element 13 actuated by handwheel 88 joins through hole 84 the side of the distance piece 83 facing the propellant container 3. Such connecting elements 87 are built to the charging stub 12 machined on the locking element 13, which are suitable for taking in a giant $CO_2$ 2 bottle 35. The connecting elements 87 are not shown in detail, because they are known from other fields of the technical life, e.g. from the household type siphon bottle.

The apparatus functions as follows.

After installing the $CO_2$ bottle 35, the propellant container 3 can be charged up through locking element 13 with propellant 4 by turning the handwheel 88. The propellant is $CO_2$ gas in the present case. The propellant container 3 can be charged up several times from a giant $CO_2$ bottle 35. The charge 1 can be put into the ejection tube as well. The ball pivot 33 is closed as illustrated during charging. The apparatus is actuated upon opening the ball pivot 22 by turning the handle 81, and the propellant 4 flows through the transfer port 8 below charge 1. This triggers ejection of the charge 1.

Figure 7:
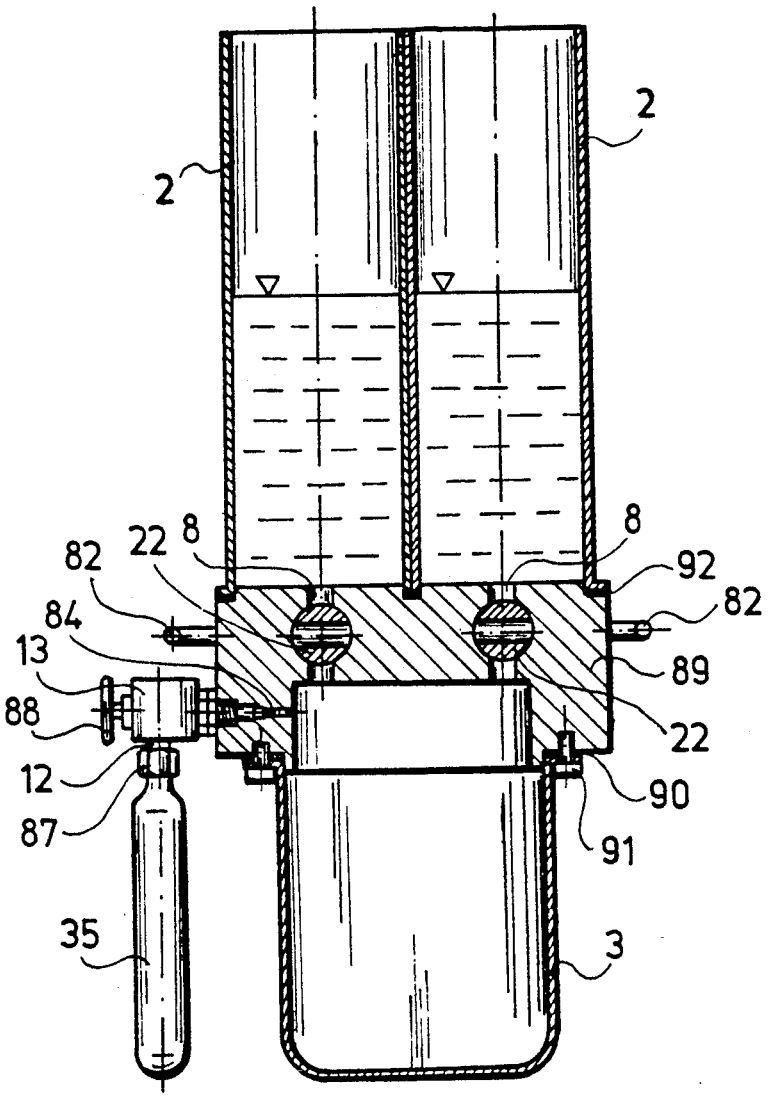
FIG. 7 is the longitudinal section of a fourth version.

A version of the previous apparatus made similarly for manual use is shown in FIG. 7.

Two ejection tubes 2 are connected to the distance piece 89. The ejection tubes 2 are flanged, sealed by gasket 92. They are fixed with screws (not shown).

A single propellant container 3 is fixed with screws 91 to the other side of the distance piece 89. It is sealed by gasket 90.

A transfer port 8 is machined in the distance piece 89 for each ejection tube 2, and each transfer port is provided with ball pivots 22 actuated by handles 82.

The locking element 13 opened and closed by handwheel 88 is connected to hole 84 in the distance piece 89 opening into the propellant container 3. A $CO_2$ bottle 35 is connected via connecting elements 87 with charging stub 12 machined on the locking element 13.

The apparatus functions as described earlier.

Naturally the two ejection tubes 2 can be actuated after each other following the repeated charge up of the propellant container 3. The apparatus has the advantage that each ejection tube 2 can be charged up in advance with charge 1, and several charges 1 can be ejected without the need of using the apparatus together with the charging hoses, or to return to the base for charge up.

Figure 8:
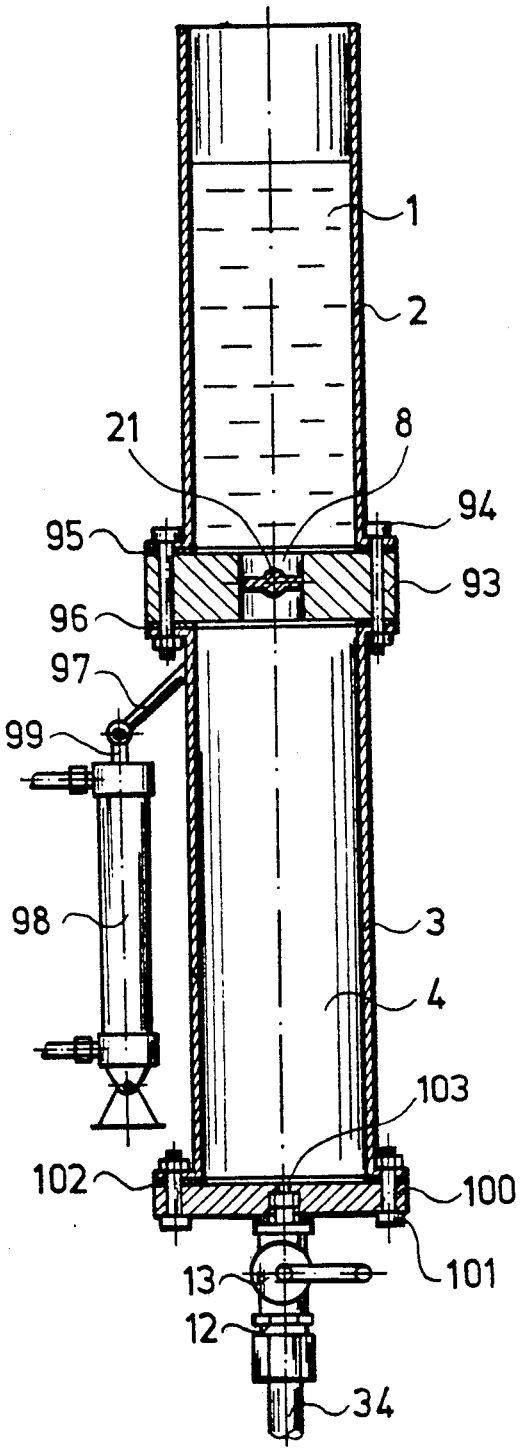
FIG. 8 is the longitudinal section of a fifth version.

FIG. 8 shows a version of the apparatus fixed to distance piece 93 with screws 94, and sealed by gaskets 95 and 96. The distance piece 93 incorporates the transfer port 8 with butterfly valve 21 built in. The valve lever 97 of the butterfly valve 21 is hinged to piston rod 99 of the cylinder 98.

The propellant container 3 is closed with bottom element 100, sealed with gasket 102 and fixed with screws 101. Locking element 13 with charging stub 12 is connected with hole 103 of the bottom element 100. The charging stub 12 is connected through flexible hose 34 with the propellant power source (not shown).

The operation does not require detailed description. After admitting the charge 1 and propellant 4, the butterfly valve 21 can be opened with the aid of cylinder 93, upon which the charge 1 is ejected.

It should be noted that the propellant 4 must not be in gaseous state for charge up, it may be liquefied $CO_2$ gas just as well. This—as described before—flows below the charge 1 already in gaseous state upon opening the butterfly Valve 21.

Figure 9:
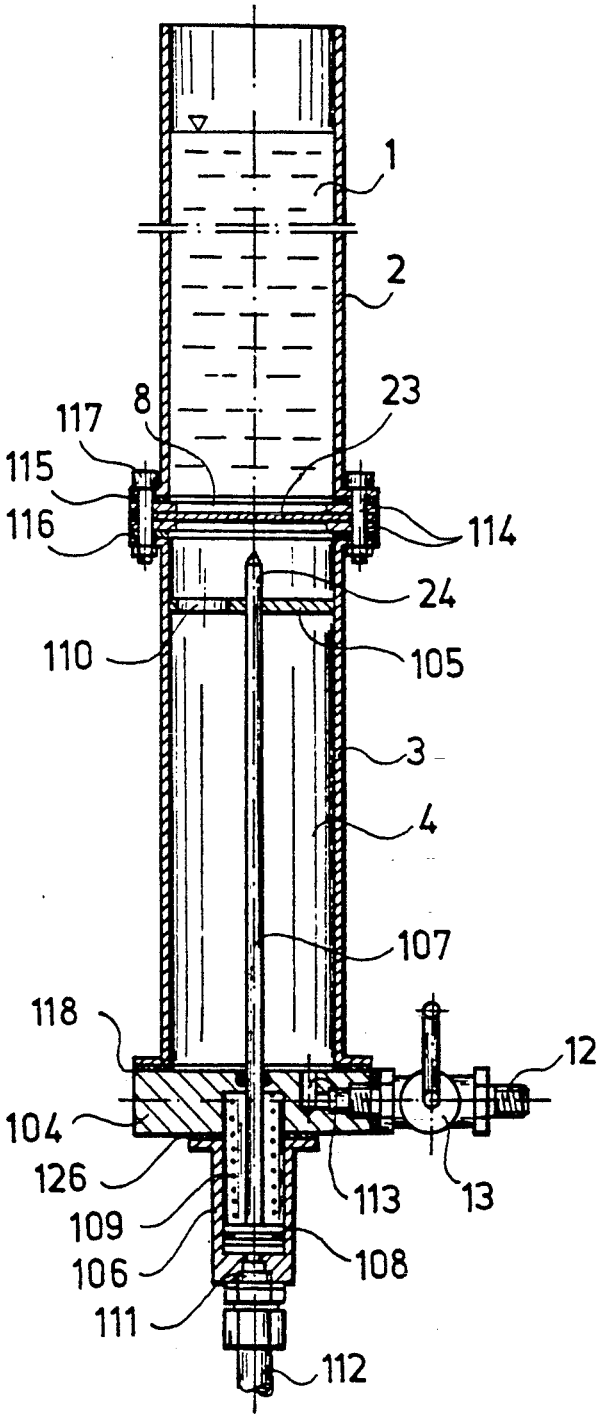
FIG. 9 is the longitudinal section of a sixth version
Figure 10:
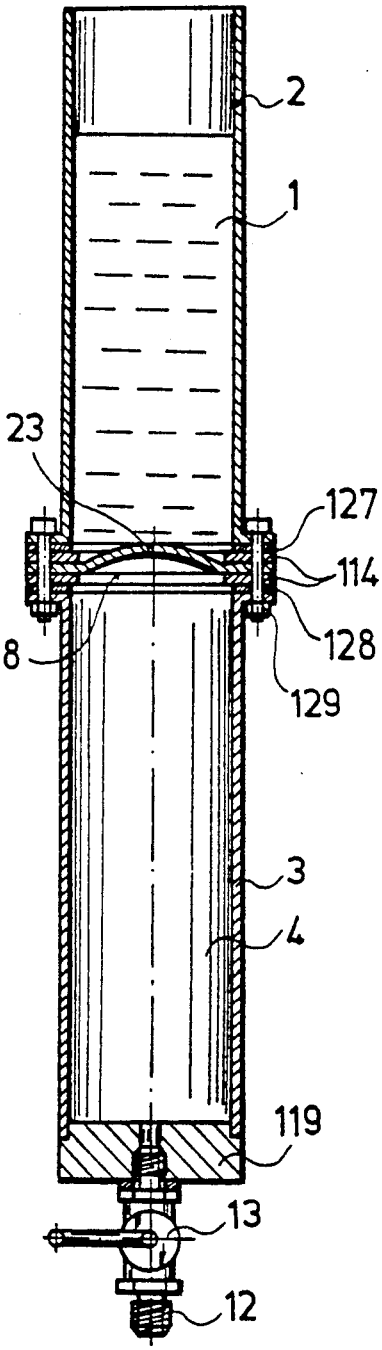
FIG. 10 is the longitudinal section of a seventh version.
Figure 11:
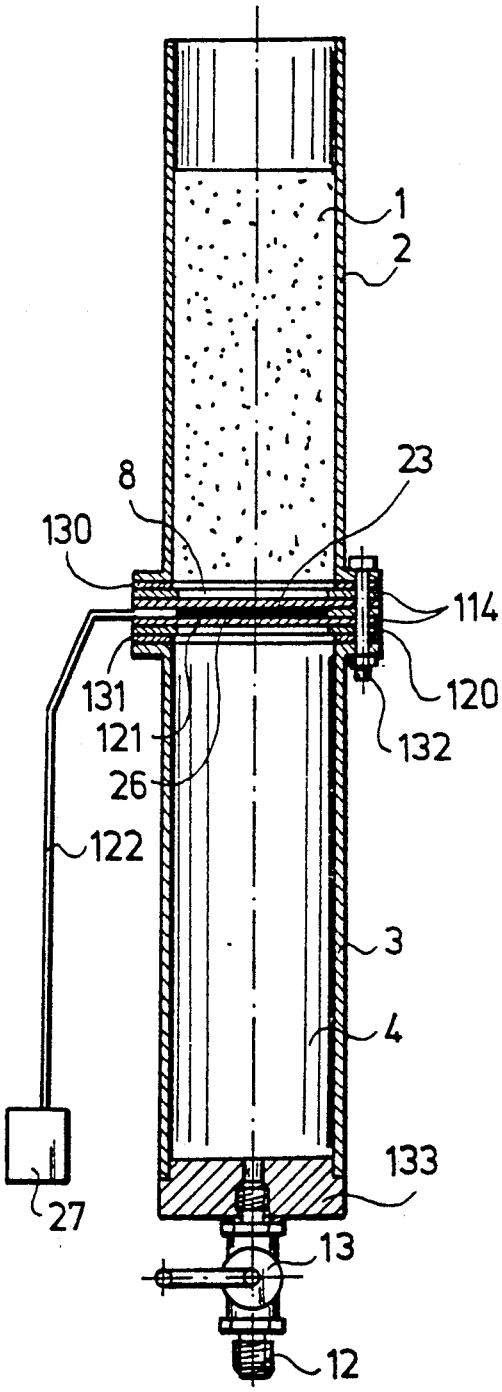
FIG. 11 is the longitudinal section of an eight version.

FIGS. 9 to 11 show an embodiment wherein the transfer part 8 is closed by a membrane 23. This can be made individually, or it may be factory-made, or ready-made hermetically sealed slotted disc. In the factory production, the membrane 23 is worked together with the surrounding clamping rings 114 as to be leakage-proof without the use of packing. A semi-finished and completely ready-made slotted disc can also be used for the apparatus according to the invention.

In the factory-made apparatus shown in FIG. 9, the ejection tube 2 is built to one side of the membrane 23 surrounded with clamping rings 114, while the propellant container 3 is built to the other side, sealed by gaskets 115 and 116 and fixed with screw 117.

A bottom element 104 together with gasket 118 and screws (not shown) is mounted to the other end of the propellant container 3, which is connected through duct 113 with locking element 13 and charging stub 12. A cylinder 106 with gasket 126 and screws (not shown) is built on the bottom element 104.

A bursting mandrel 24 is at the membrane 23 on the piston rod 207 of piston 108 of cylinder 106. The piston rod 107 is supported against deflection by guide disc 105 fixed to the propellant container 3 by stich welding or sticking. The unobstructed flow of propellant 4 is ensured by holes 110 in the guide disc 105. The cylinder 106 with the aid of pipe nipple 111 and flexible hose 112 can be connected with a compressed air aggregate. The piston rod 107 is held in normal position by spring 109.

The apparatus begins to function upon applying pressure to the cylinder 106 after charging up the charge 1 and propellant 4. The piston 108 and the bursting mandrel 24 at the end of the piston rod 107 move at high speed in the direction of the membrane 23 and breaking it through. The propellant 4 flows through the free transfer port 8 below charge 1 and ejects it.

In the apparatus according to FIG. 10, a forepressed membrane 23 is mounted between the ejection tube 2 and propellant container 3 with the aid of clamping rings 114, gaskets 127 and 128 and screws 129. The end of the propellant container 3 is closed by the welded-in bottom element 19, into which the locking element 13 with charging stub 12 is fitted.

The membrane 23 should have a compressive strength somewhat higher than pressure of the propellant 4 in the propellant container 3 during charge up.

For making the apparatus operative, the pressure of the propellant 4 is further increased by opening the locking element 13 during ejection, the increased pressure cracks the membrane 23, whereby the transfer port 8 is freed.

The principle of operation demonstrates that the compressive strength of the membrane 23 should be selected to 1.2–1.5 times the rated charging pressure, thus it will be sufficiently safe against accidental rupture, but no excessive pressure is required for the ejection.

FIG. 11 presents an apparatus used in such field, where remote control of the apparatus can not be accomplished with traditional elements. Such field is for example the deep working in mine.

Here the membrane 23 built between the clamping rings 114 is joined to the ejection tube with gasket 130, to the propellant container with the insertion of a choking plate, supporting clamping ring 120, gasket 131 and screws 132. The end of the propellant container 3 is closed with a welded-in bottom element 133, into which the locking element 13 with charging stub 12 are mounted.

For actuation of the apparatus, first a detonating mechanism 26 is placed between the membrane 23 and choking plate 121. The detonating mechanism 26 may be any traditional explosive with electrically ignited primer, the electric wire of which is led in alongside the choking plate 121. Installation of the detonating mechanism 26 is followed by filling in the charge 1 and propellant 4.

Here it is noted that besides water, many other materials can be used for charge 1. Such are for example the powders used for fire-fighting, moreover rock flour too may be the charge 1 in case of pit gas danger.

In deep working mines, the apparatus is used as follows. As many apparatuses—in charged condition—as required by the volume of the entries and size of the charge 1 are laid on the area endangered by pit gas. The electric wires 122 are connected to a—symbolically illustrated—firing mechanism 27 provided with sensor 141 reacting to the presence of pit gas, or fire. When for example the pit gas reaches the explosive level, the firing mechanism 27 explodes the detonating mechanism 26, which cracks the membrane 23 and the choking plate 121 made of much weaker material. Thus the propellant 4 flows through the transfer port 8 below the charge, and ejects it.

The propellant 4 can be brought about with the aid of explosive as well.

Figure 12:
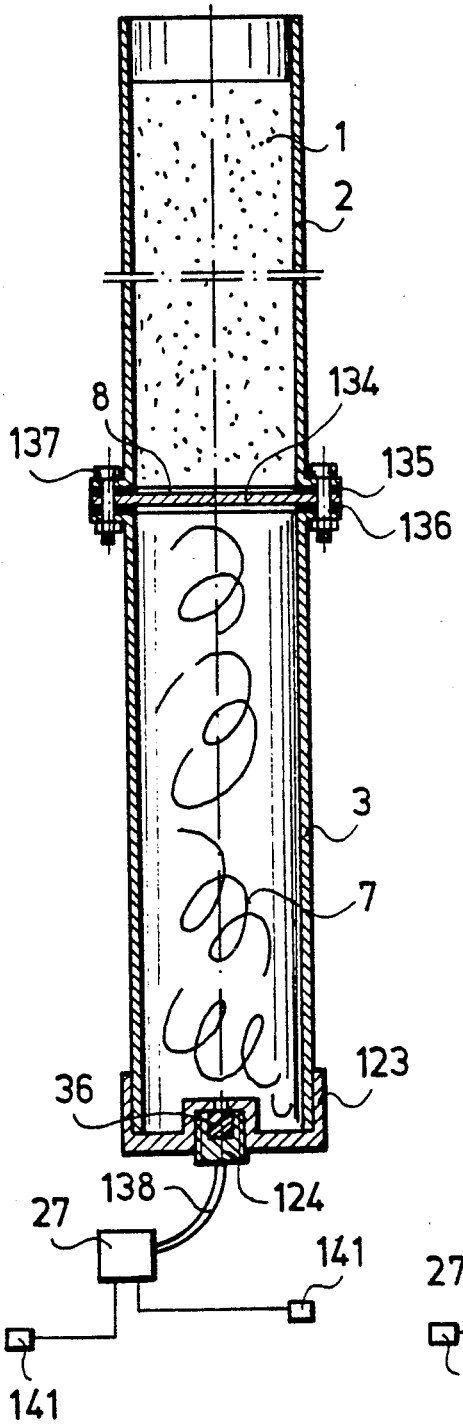
FIG. 12 is the longitudinal section of a ninth version.

In the apparatus shown in FIG. 12, a locking disc 134 is mounted with gaskets 135 and 136 and screw 137 between the ejection tube 2 and propellant container 3. The propellant container 3 is closed by a threaded bottom element 123, into which a detonating mechanism 36 is placed with the aid of cap screw 124, connected through electric wire 138 with the firing mechanism 27. The sensing devices 141 are connected to the firing mechanism 27.

For operation of the apparatus an explosive 7 is placed into the propellant container 3. This could be any low explosive. Detonation of the explosive 7 brings about the propellant flowing below the charge 1 through the transfer port 8 which becomes free upon rupture of the locking disc 134.

Figure 13:
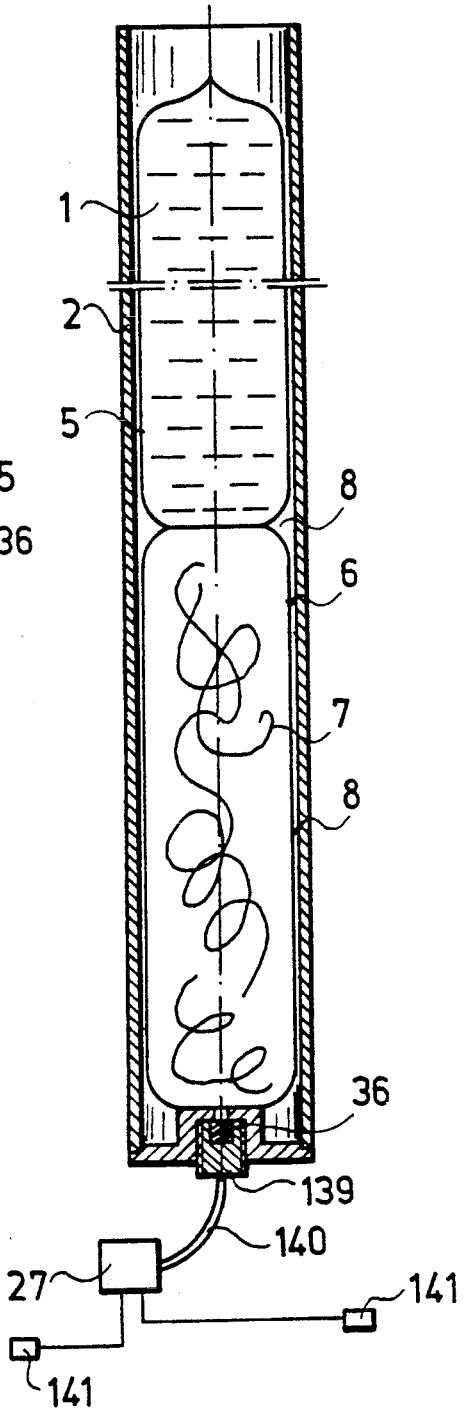
FIG. 13 is the longitudinal section of a tenth version.

FIG. 13 presents the simplest version of the apparatus. The ejection tube 2 and propellant container 3 are machined as a single tube, so the transfer port is the full cross section of the tube. The propellant container 3 is closed by a welded-in bottom element 125 into which the detonating mechanism 36 is placed with the aid of cap screw 139. The detonating mechanism 36 is connected with electric wire 140 to the firing mechanism 27. Sensing devices 141 are connected with the firing mechanism 27.

For operation of the apparatus, first the explosive 7 in a shell is placed into the propellant container 3 followed by putting on the charge 1 in a sealed bag 5 made of paper or synthetic foil. The propellant brought about upon detonation of the explosive 7 ejects the charge 1.

In connection with use of the bag 5, it should be noted, that it can be used in any version of the apparatus, since such energy is required for ejection of the charge 1 which rears apart the bag 5 by all means.

The bag 5 offers a further application possibility. With the process according to the invention only liquids or powdery materials can be ejected. With the aid of the bag 5 however, halogen gas can also be ejected, since it can be stored and filled in liquid state into the bag 5.

Figure 14:
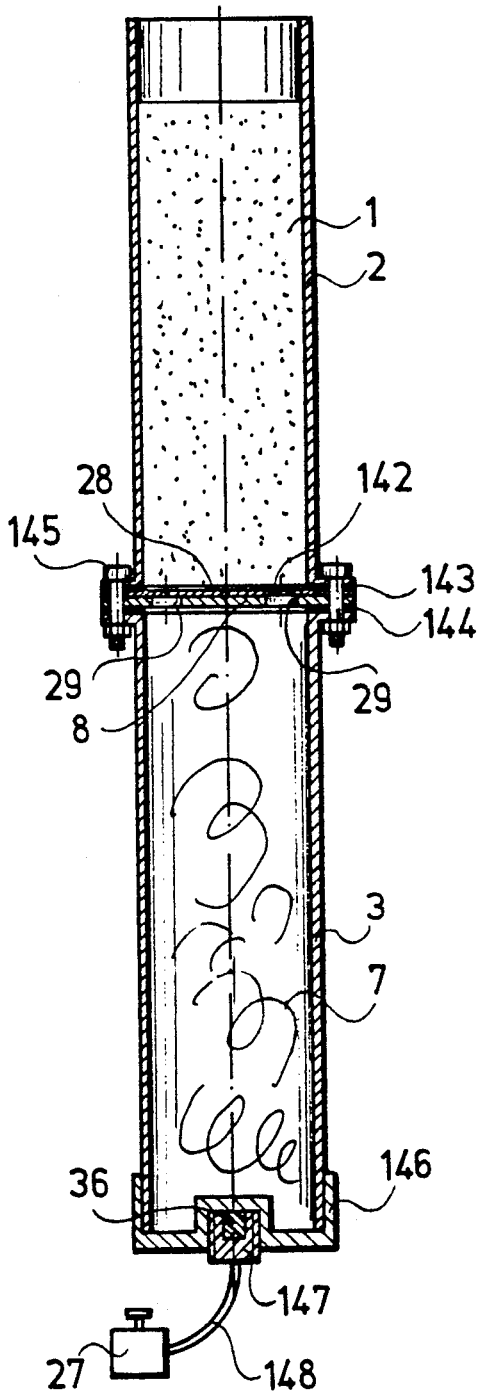
FIG. 14 is the longitudinal section of an eleventh version.

FIG. 14 shows such version of the apparatus which combines the advantages of the high energy derived from the explosion, and the holes arranged like a wreath at the tube bottom.

A bottom plate 142 is built between the ejection tube 2 and propellant container 3 with the aid of gaskets 143 and 144 and screws 145. The bottom plate 142 practically determines the tube bottom 28 of the ejection tube 2.

Holes 29 are arranged like wreath in the bottom plate 14 in the vicinity of the tube bottom's edge 28. The bottom plate 142 is closed by membrane 23 between gasket 14 and bottom plate 142. In this case the membrane 23 may be a thin sheet of low strength or a foil.

The holes 2101 are connected with the transfer port 8. According to drawing, its cross section is practically the same as that of the propellant container 3, but a construction as shown in FIG. 3 is also feasible. It. should be noted that although the Figures—except one—present such versions, where diameter of the ejection tube and propellant container is the same, but this is not necessary at all.

The propellant container 3 is closed by a bottom element 146 into which the detonating mechanism 36 is fixed with the aid of a cap screw 147. The detonating mechanism is interconnected through electric wire 148 with a manually operated firing mechanism 27.

For operation of the apparatus, the charge 1 is placed into the ejection tube 2. and propellant container 3 is filed with explosive 7. The firing mechanism 27 explodes the detonator, and the explosive 7.

The propellant brought about by the explosive 7 flows through the holes 29, tears apart the membrane 23, then flowing below the charge 2, ejects it.

The foregoing description demonstrates that one of the main fileds of application of the process and apparatus is the fire-fighting. It is assumed to be an extremely great advantage, that—due to the fine distribution—- considerably less amount of fire-fighting material, first of all water is required, as if it were discharged with traditional means.

Naturally, the invention is applicable elsewhere, and the process can be relaized with other apparatuses as well.

I claim:

1. Process for the fine dispersion of liquid or powders in gaseous medium, characterized in that a charge (1) of the liquid or powder is put into an ejection tube (2), and pressurized gaseous propellant (4) is admitted at explosion-like speed behind the charge (1), container (3) is filled with said propellant (4) of at least 10 bar pressure, and the propellant (4) is conducted from the container (3) behind the charge (1) in the ejection tube (2), with a maximum of 20 msec., and wherein the volume of said charge (1) amounts to 25-100% of the volume of the ejection tube (2), and the volume of said propellant (4) amount to 30-750 times the volume of the charge (1) in normal condition.

2. Process according to claim 1, characterized in that the liquid or powder is filled into a bag (5) made of synthetic foil or paper, then the bag (5) is closed and placed into the ejection tube (2).

3. Process according to claim 1, characterized in that the propellant (4) is brought about by an explosion.

4. Process according to claim 3, characterized in than an explosive (7) in a conventional shell (6) is placed into the propellant container (3) and the charge (1) filled into the bag (5) is placed directly on said explosive.

5. Apparatus for the fine dispersion of liquid or powder in gaseous medium, comprising an ejection tube (2) taking in a charge of the liquid or powder (1), one end of the ejection tube (2) being connected with a propellant container (3), the ejection tube (2) being interconnected with the propellant container (3) by at least one transfer port (8) closed by a quick-action locking element, wherein the ration (L/D) between the length (L) of the ejection tube (2) and its inside diameter (d) is 2 to 20.

6. Apparatus according to claim 5, characterized in that an automatically closing closure element (10) consisting of segments and made of elastic material is arranged at the mouth (9) of the ejection tube (2).

7. Apparatus according to claim 5, characterized in that the ejection tube (2) has a charging stub (31) provided with a valve (32) connected through a flexible hose (33) with a liquid supply system.

8. Apparatus according to claim 5, characterized in that a tube bottom (28) is formed at the end of the ejection tube (2) facing the propellant container (3), and holes (29) branch off from the transfer port (8) in the direction of the ejection tube (2), the holes having openings (30) formed in the tube bottom (28).

9. Apparatus according to claim 5, characterized in that said container (3) has a charging stub (12) provided with a valve (13) for connection with a propellant supplying appliance.

10. Apparatus according to claim 9, characterized in that the charging stub (12) of the propellant container (3) provided with the valve (13) is connected through a flexible hose (34) to said propellant supplying appliance, and wherein said appliance supplies high pressure gas to the charging stub.

11. Apparatus according to claim 9, characterized in that the charging stub (12) of the propellant container (3) provided with the valve (13) has elements to take in a $CO_2$ cartridge.

12. Apparatus according to claim 5, characterized in that the locking element closing the transfer port (8) interconnecting the ejection tube (2) with the propellant container (3) is a valve (14) resting on a valve seat (15) machined around the transfer port (8) from the direction of the propellant container (3), the valve (14) being in actuating connection with a piston (16) situated in a cylinder (17) having a cylinder space (37), the cylinder space (17) being interconnected with the propellant container (3) through a check valve (18) closing towards the cylinder space (37), the apparatus further comprising a valve (19) connecting the cylinder space with the surroundings, finally a charging stub (12) of the propellant container (3) being provided with a valve (13) directly connected with the cylinder space (37) of the cylinder (17).

13. Apparatus according to claim 12, characterized in that the valve (13) in the charging stub (12) of the propellant container (3) interconnected with the cylinder space (37) of the cylinder (17) and the valve (19) interconnecting the cylinder space (37) of the cylinder (17) with the surroundings are machined as a single three-positioned valve (20).

14. Apparatus according to claim 12, characterized in that the valve closing the transfer port (8) that interconnects the ejection tube (2) with the propellant container (3) and the actuating piston (16) are machined as a single piece, and the cross section (a) of the transfer port (8) is smaller than cross section (A) of the cylinder's (17) cylinder space (37).

15. Apparatus according to claim 5, characterized in that the locking element closing the transfer port (8) that interconnects the ejection tube (2) with the propellant container (3) is a butterfly valve (21).

16. Apparatus according to claim 5, characterized in that the locking element closing the transfer port (8) that interconnects the ejection tube (2) with the propellant container (3) is a ball pivot (22).

17. Apparatus according to claim 5, characterized in that the locking element closing the transfer port (8) that interconnects the ejection tube (2) with the propellant container (3) is a membrane (23).

18. Apparatus according to claim 17, characterized in that a bursting mandrel (24) is arranged from the direction of the propellant container (3) behind the membrane (23) closing the transfer port (8) that interconnects the ejection tube with the propellant container (3) and a shank (25) of the bursting mandrel (24) is in mechanical connection with an actuating mechanism arranged outside the propellant container (3).

19. Apparatus according to claim 17, characterized in that the compressive strength of the membrane (23) closing the transfer port (8) that interconnects the ejection tube (2) with the propellant container (3) is 1.2–1.5-times the rated charging pressure of the propellant container.

20. Apparatus according to claim 17, characterized in that a detonating mechanism (26) including a primer cap is built to the membrane (23) closing the transfer port (8) that interconnects the ejection tube (2) with the propellant container (3), and said detonating mechanism (26) is interconnected with a firing mechanism (27).

21. Apparatus according to claim 5, characterized in that explosive (7) is in the propellant container (3) to which a conventional detonating mechanism (36) is interconnected with a firing mechanism (27).

22. Apparatus according to claim 21, characterized in that the firing mechanism (27) interconnect with the detonating mechanism (26) is in actuating connection with an instrument or instrument system sensing the presence of explosive gas mixture and/or fire.

23. Apparatus according to claim 5, characterized in that at least two ejection tubes (2) are built together with a common propellant container (3), and each of said ejection tube (2) is connected separately with the common propellant container (3) via transfer ports (8) each closed by a locking element.

24. A process for the fine dispersion of liquid or powders in gaseous medium, utilizing an ejection tube (2) taking in a charge of the liquid or powder, one end of the ejection tube (2) being connected with a propellant container (3), the ejection tube (2) being interconnected with the propellant container (3) by at least one transfer port (8) closed by a quick-action locking element, comprising emplacing the liquid or powder (1) in the ejection tube (2), emplacing a propellant (4) in the propellant container (3), and actuating the quick-action locking element to interconnect the propellant container (3) with the ejection tube (2) via said at least one transfer port (8) thereby to admit said propellant (4) at explosion-like speed behind the charge, wherein a propellant container (3) is filled with said propellant (4) of at least 10 bar pressure, and the propellant (4) is conducted from the propellant container (3) behind the charge (1) in the ejection tube (2) in a maximum of 20 msec., said charge (1) amount to 25–100% of the volume of the ejection tube (2), and said propellant (4) amounts to 30–750 times the volume of the charge (1) in normal condition.

* * * * *